US008375752B2

(12) United States Patent
Chang et al.

(10) Patent No.: US 8,375,752 B2
(45) Date of Patent: Feb. 19, 2013

(54) KEY BOX

(75) Inventors: Wei-Yu Chang, New Taipei (TW); Wei-Chih Chang, New Taipei (TW)

(73) Assignee: Shyh Ru Metallic Industrial Corp., New Taipei (TW)

( * ) Notice: Subject to any disclaimer, the term of this patent is extended or adjusted under 35 U.S.C. 154(b) by 0 days.

(21) Appl. No.: 13/214,316

(22) Filed: Aug. 22, 2011

(65) Prior Publication Data

US 2012/0042703 A1 Feb. 23, 2012

Related U.S. Application Data

(60) Provisional application No. 61/376,212, filed on Aug. 23, 2010.

(51) Int. Cl.
*E05B 47/06* (2006.01)
*E05B 65/52* (2006.01)

(52) U.S. Cl. ..... 70/63; 70/162; 70/278.1; 70/278.7; 70/279.1; 70/283; 70/284; 70/285

(58) Field of Classification Search ..... 70/63, 277, 70/278.1, 283, 283.1, 159–162, 284, 285, 70/213, 214, DIG. 63, DIG. 71, 278.7, 279.1; 109/59 R, 59 T
See application file for complete search history.

(56) References Cited

U.S. PATENT DOCUMENTS

| | | | | |
|---|---|---|---|---|
| 1,833,572 | A * | 11/1931 | Hardesty | 70/262 |
| 2,729,089 | A * | 1/1956 | Pelcin | 70/151 R |
| 4,470,277 | A * | 9/1984 | Uyeda | 70/118 |
| 4,651,544 | A * | 3/1987 | Hungerford | 70/63 |
| 4,774,512 | A * | 9/1988 | Jolidon et al. | 340/5.22 |
| 5,701,770 | A * | 12/1997 | Cook et al. | 70/63 |
| 5,850,967 | A * | 12/1998 | White | 232/17 |
| 6,272,890 | B1 * | 8/2001 | Huston | 70/423 |
| 6,363,760 | B1 * | 4/2002 | Sigmond | 70/63 |
| 6,679,087 | B2 * | 1/2004 | Suggs et al. | 70/153 |
| 6,845,640 | B2 * | 1/2005 | Loeff et al. | 70/63 |
| 7,464,570 | B1 * | 12/2008 | Chen | 70/267 |
| 7,516,631 | B2 * | 4/2009 | Hacker et al. | 70/63 |
| 2005/0247085 | A1 * | 11/2005 | Porter | 70/210 |
| 2006/0032418 | A1 * | 2/2006 | Smith | 109/59 R |
| 2006/0230794 | A1 * | 10/2006 | Liu | 70/63 |
| 2009/0071208 | A1 * | 3/2009 | Wang | 70/277 |
| 2010/0281934 | A1 * | 11/2010 | Su | 70/278.1 |

* cited by examiner

*Primary Examiner* — Lloyd Gall
(74) *Attorney, Agent, or Firm* — WPAT PC; Justin King

(57) ABSTRACT

According to the present invention, a key box is provided to include: a body; a cover, pivotally connected with the body to render an open state and a closed state; and a panel set, embedded on the cover, comprising a keypad module and a lock module. Wherein, by manipulating either the keypad module or the lock module, the open state and the closed state can be switched.

9 Claims, 6 Drawing Sheets

KEY BOX

FIELD OF THE INVENTION

The present invention relates to a safety box apparatus, and more particularly, to an electronic key box.

BACKGROUND OF THE INVENTION

Conventional safety boxes are mostly locked by mechanical means, and can only be opened by a key that is carried by a user. Further, for electronic safety boxes locked by electronic passwords, it is necessary that a user remembers a password set by oneself so that a safety box can be opened by pressing number keys.

SUMMARY OF THE INVENTION

It is an objective of the present invention to provide an electronic key box, which offers dual functions of electronic password and mechanical locks to optimize utilization flexibilities.

It is another objective of the present invention to provide an electronic key box, which covers a keyhole of a mechanical lock when the mechanical lock is not in use to offer both security and esthetic effects.

To achieve the objectives above, the present invention provides a key box comprising: a body; a cover, pivotally connected with the body to render an open state and a closed state; and a panel set, embedded on the cover, comprising a keypad module and a lock module. Wherein, by manipulating either the keypad module or the lock module, the open state and the closed state can be switched.

The key box of the present invention further comprises a switch module provided at an inner side of the cover. The switch module comprises: a plate; a sliding piece, slidably provided on the plate; a pair of rotating pieces, rotatably provided on the plate; and an solenoid switch, comprising a blocking section for blocking against the sliding piece under the closed state and being disengaged from the sliding piece under the open state.

According to the key box of the present invention, the sliding piece comprises a push piece for coordinating with the keypad module for switching the key box between the open state and the closed state.

According to the key box of the present invention, the panel set comprises an opening comprising at two sides thereof a pair of substantially parallel guiding tracks, and a button accommodated in the opening and is restrained to slide along a predetermined direction according to the guiding tracks.

According to the key box of the present invention, the plate further comprises a positioning piece for positioning the blocking section.

According to the key box of the present invention, wherein the positioning piece comprises non-magnetizing material.

According to the key box of the present invention, another sliding piece is further comprised and is slidably provided on the sliding piece.

According to the key box of the present invention, the another sliding piece comprises a push piece for coordinating with the lock module for switching the key box between the open state and the closed state.

According to the key box of the present invention, a concealing cover is further comprised for movably covering the lock module.

According to the key box of the present invention, a circuit board is further comprised near the keypad module and is electrically connected with the keypad module and the solenoid switch.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENT

Figure 1:
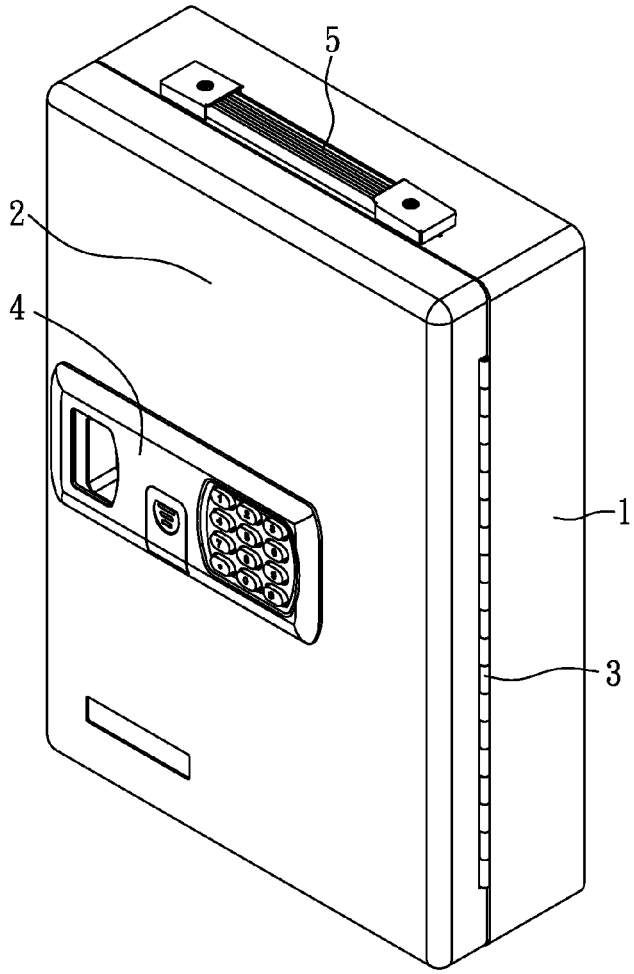
FIG. 1 is an elevational view of a key box according to a preferred embodiment of the present invention.
Figure 3:
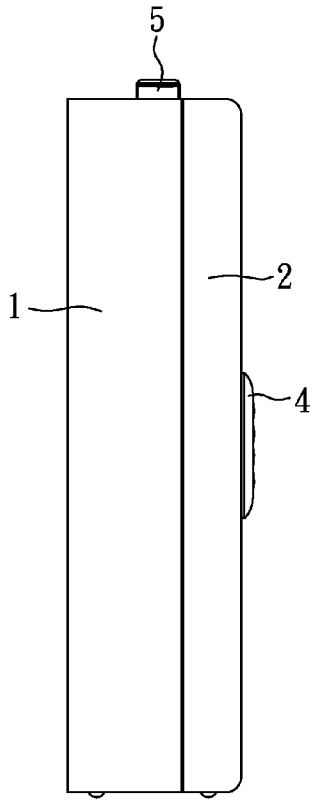
FIG. 3 is a side view of the key box in FIG. 1.
Figure 2:
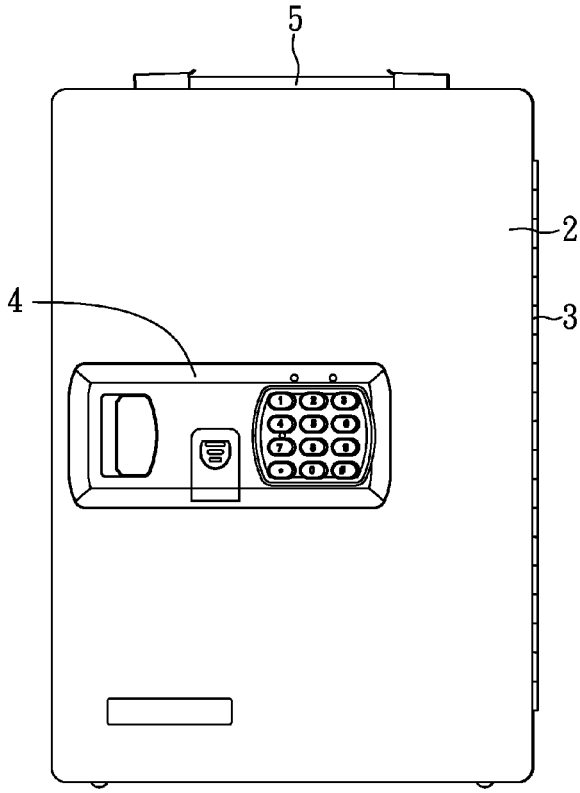
FIG. 2 is a front view of the key box in FIG. 1.

FIGS. 1, 2 and 3 respectively show an elevational view, a front view and a side view of an electronic key box according to a preferred embodiment of the present invention. Referring to FIGS. 1 to 3, the electronic key box according to a preferred embodiment of the present invention comprises a hollow body 1, a cover 2, a pivot 3, a panel set 4 and a handle 5. The cover 2 is pivotally connected to the body 1 via the pivot 3, so that the cover 2 is allowed to become a closed state or an open state relative to the body 1. Under a closed state, the cover 2 is closely engaged with the body 1 to prevent a risk of undesired peeping or undesired obtaining a content of the box, and so a shape of the cover 2 is necessarily formed to match a geometric shape of the body 1. Further, the cover 2 and the body 1, being rigid and endurable, are generally formed by a strong material such as metal or plastic steel.

Referring to FIGS. 1 to 3, the handle 5 is fixed to the body 1, and allows grasping of a user so that the user may move or carry the key box when the cover 2 is closed relative the body 1. Further, the panel set 4, embedded on the cover 2 at one side of the cover 2, comprises a keypad and a lock for allowing a user to open or close the key box. The keypad and the lock shall be described below.

Figure 4:
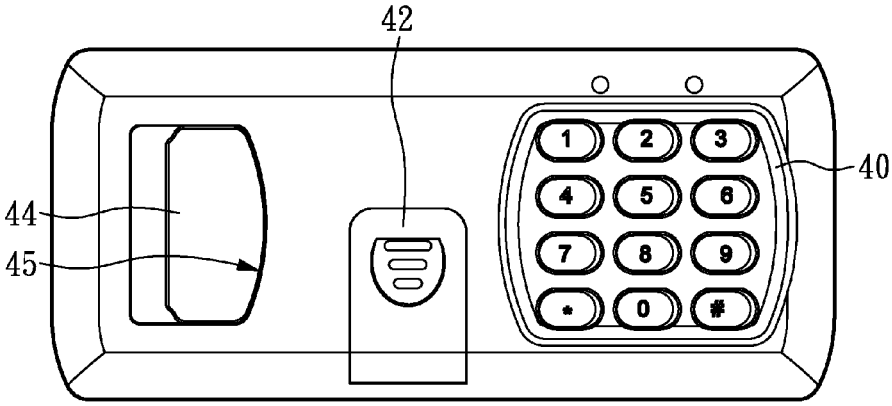
FIG. 4 is a front view of a panel set.
Figure 5:
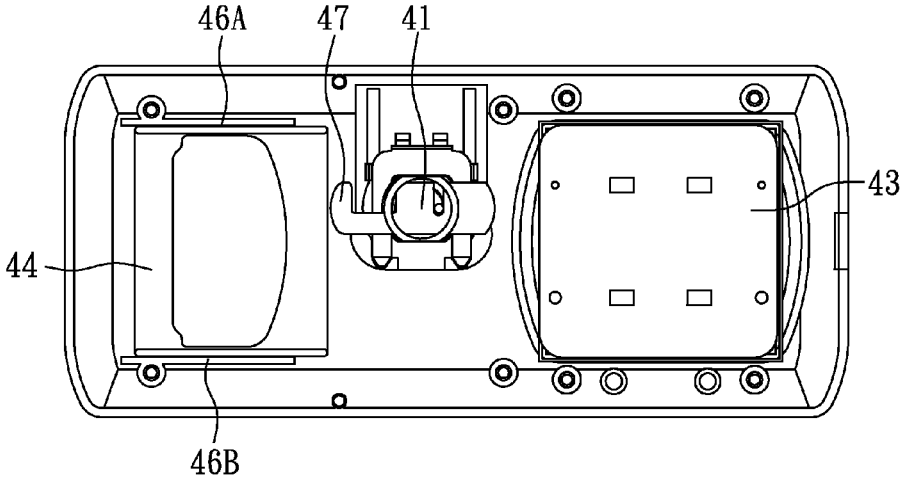
FIG. 5 is a rear view of a panel set.

FIGS. 4 and 5 respectively show a front view and a rear view of the panel set 4. As shown, the panel set 4 comprises a keypad module 40, a lock module 41 and a button 44. The key module 40 comprises numeral keys of 0 to 9, and symbol keys of "*" and "#", and is electrically connected to a circuit board 43. Preferably, the circuit board 43 is provided closely to a rear side of the keypad module 40, such that the circuit board 43 is facilitated to receive a corresponding electronic signal when a user presses the numeral keys or symbol keys of the keypad module 40. The lock module 41 comprises a hook section 47 to be described shortly. The panel set 4 further comprises an opening 45, and a pair of guiding tracks 46A and 46B (as shown in FIG. 5) in the inner side of the opening 45 to accommodate the button 44 therein, such that the button 44 is slidable according to the restraints of the guiding tracks 46A and 46B along a predetermined direction.

Figure 6:
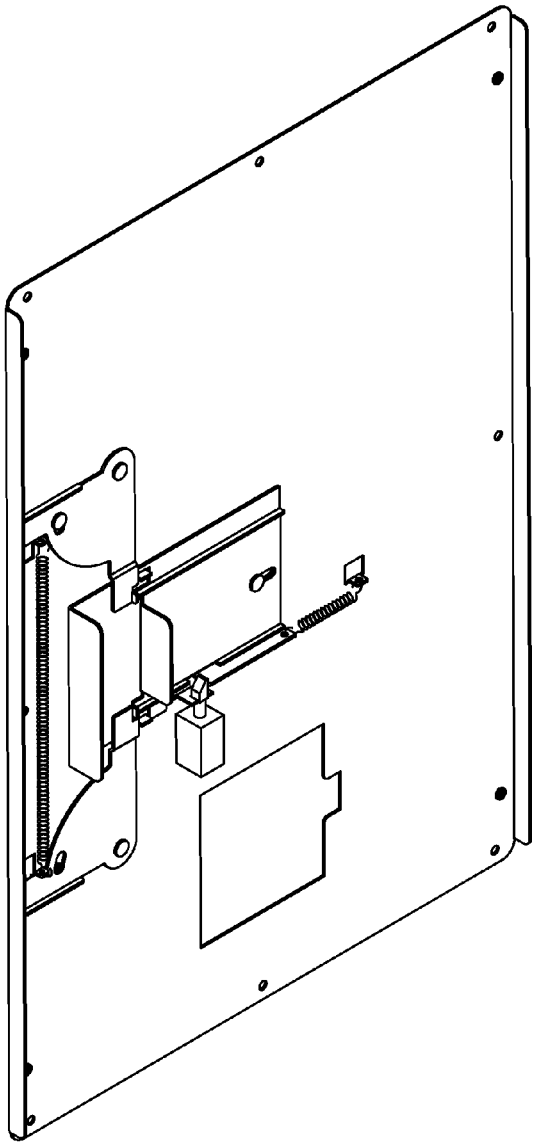
FIG. 6 is an elevational view of a switch module.
Figure 7:
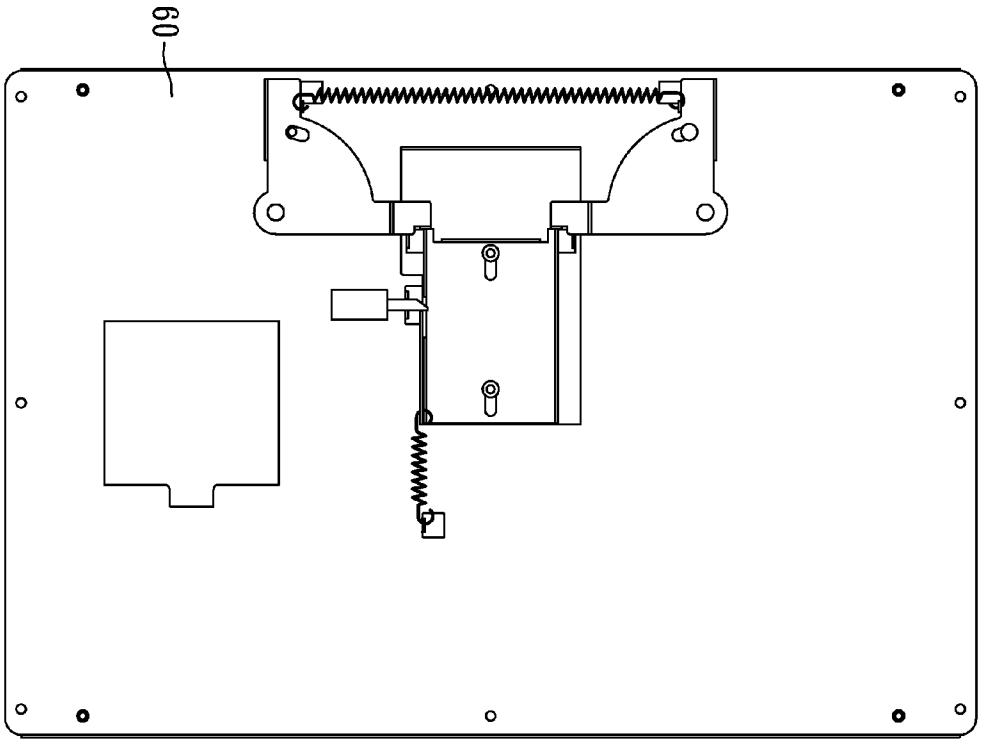
FIG. 7 is a front view of a switch module.
Figure 8:
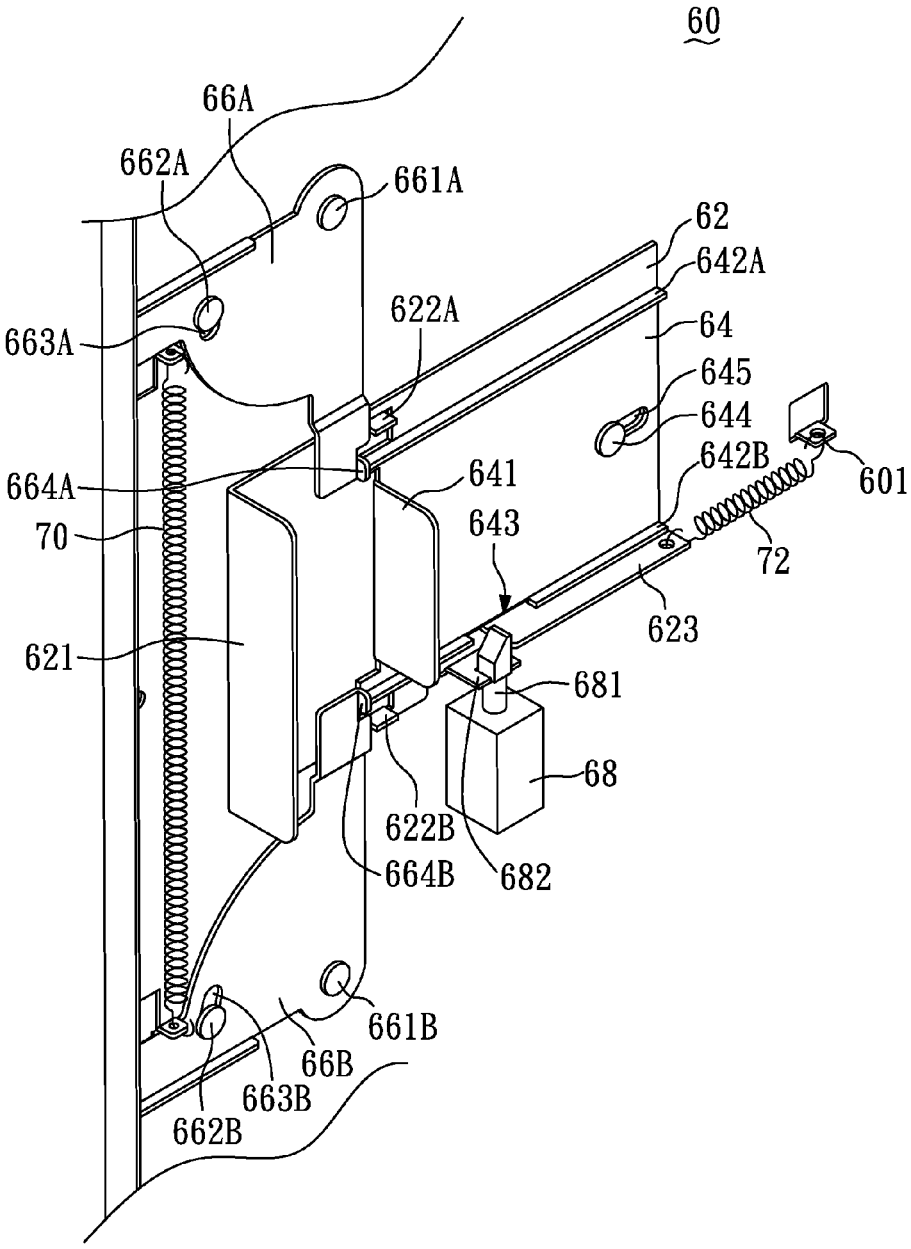
FIG. 8 is a partial enlarged view of a switch module.

FIGS. 6 and 7 respectively show an elevational view and a front view of a switch module. The switch module is provided at a rear side of the cover 2, and is a mechanical structure for coordinating with the keypad module 40 and the lock module 41 of the panel set 4. FIG. 8 shows a partial enlarged view depicting details of the switch module. Referring to FIGS. 6 to 8, all components of the switch module are provided on a plate 60, and the switch module comprises a button sliding piece 62, a lock sliding piece 64, a pair of rotating pieces 66A and 66B, and a solenoid switch 68.

The rotating pieces 66A and 66B are spaced with a fixed distance in between, and are respectively rotatably provided on the plate 60 via rivets 661A/662A and 661B/662B. The rotating pieces 66A and 66B respectively comprise arched openings 663A and 663B. When the rotating pieces 66A and 66B respectively rotate around the rivets 661A and 661B as axes thereof, the rotating pieces 66A and 66B are enabled to rotate at closed positions or open positions since the rivets 662A and 662B respectively coordinate with the arched openings 663A and 663B. Referring to FIG. 8, the rotating pieces 66A and 66B are under a closed state. The rotating pieces 66A and 66B are tied closer by means of a spring 70. When no external force is exerted on the key box, the rotating pieces 66A and 66B are rest on the closed positions by means of the spring 70 coordinating with the rivets 662A and 662B.

The button sliding piece 62 may be slidably provided on the plate 60, and the lock sliding piece 64 may be slidably provided on the button sliding piece 62. In other words, the lock sliding piece 64 is superimposed on the button sliding piece 62, and both are provided over the plate 60 via the rivet 644. The lock sliding piece 64 and the button sliding piece 62 correspond to respective openings. As shown in FIG. 8, the rivet 644 coordinates with the opening 645 of the lock sliding piece 64 so that the lock sliding piece 64 is allowed to slide at the closed position or the open position. Similarly, the button sliding piece 62 also corresponds to an opening (not shown in the drawing) and coordinates with the rivet 644 so that the button sliding piece 62 is allowed to slide at the closed position or the open position. According to an embodiment of the present invention, the button sliding piece 62 actuates the lock sliding piece 64 to slide simultaneously. However, the button sliding piece 62 is not actuated to slide by the sliding of the lock sliding piece 64.

Referring to FIG. 8, the lock sliding piece 64 comprises strip sections 642A and 642B at two sides thereof. The strip sections 642A and 642B respectively butt against projecting portion 664A of the rotating piece 66A and the projecting portion 664B of the rotating piece 66B, and the strip section 642B comprises a breach 643 at an end near the solenoid switch 68. Further, the lock sliding piece 64 comprises a push piece 641 vertically extended from its one end near the rotating pieces 66A and 66B. When a user opens the box with a key, the hook section 47 of the lock module 41 thrusts force upon the push piece 641, such that the lock sliding piece 64 respectively applies force on the projecting portion 664A of the rotating plate 66A and the projecting portion 664B of the rotating plate 66B. Accordingly, the rotating pieces 66A and 66B are rotated to deform and extend the spring 70 to open the box. When a user closes the box with a key, the hook section 47 of the lock module 41 is disengaged from the push piece 641. Due to a restoring force of the spring 70, the lock sliding piece 64 is pushed away from rotating pieces 66A and 66B by the projecting portion 664A of the rotating plate 66A and the projecting portion 664B of the rotating plate 66B and back to the closed position.

The button sliding piece 62 comprises projecting portions 622A and 662B at two sides thereof for respectively butting against an end of the rotating pieces 66A and 66B. The button sliding piece 62 comprises a push piece 621 vertically extended from its one end near the rotating pieces 66A and 66B. When a user opens the box by pressing the button 44, the button 44 thrusts force upon the push piece 621, such that the button sliding piece 62 respectively applies force on one end of the rotating pieces 66A and 66B. Accordingly, the rotating pieces 66A and 66B are rotated to deform and extend the spring 70 to open the box. When the button 44 is not pressed by a user, due to a restoring force of the spring 70, the button sliding piece 62 is pushed away from the rotating pieces 66A and 66B by the rotating pieces 66A and 66B and back to the closed position. According to the present invention, the button sliding piece 62 further comprises a long strip section 623 at one side near the solenoid switch 68. A spring 72 is provided between the long strip section 623 and a projecting portion 601 of the plate 60 to coordinate with the spring 70, so as to ensure that the button sliding piece 62 restores from the open position back to the closed position.

The solenoid switch 68 comprises a blocking section 681 extended from one side of the solenoid switch 68 that is near the button sliding piece 62. Further, the solenoid switch 68 is electrically connected to the circuit board 43 and is controlled by circuits on the circuit board 43. When a password entered by a user is correct, the solenoid switch 43 withdraws the blocking section 681 inwards via controls of the circuits on the circuit board 43. When the key box is under the closed state, the blocking section 681 of the solenoid switch 68 blocks against the long strip section 623 of the button sliding piece 62. At this point, the button sliding piece 62 remains immobile even when the button 44 is pressed by a user. Only when a password entered by a user is correct, the solenoid switch 68 shall withdraw the blocking section 681 inwards. At this point, by pressing the button 44 to apply force on the push piece 621, the button sliding piece 62 is enabled to slide via the projecting portions 622A and 622B to respectively apply force at one end of the rotating pieces 66A and 66B. Accordingly, the rotating pieces 66A and 66B are rotated to deform and extend the spring 70 to open the box.

To coordinate with the blocking section 681, the plate 60 comprises a positioning piece 682 for positioning. Further, to prevent a drawback that the blocking section 681 may fail to restore to its original position when electricity is cut off due to magnetization after the blocking section 681 of the solenoid switch 68 was electrically connected, the positioning piece 682 would be made of non-magnetizing material or covered with non-magnetizing material. Preferably, the positioning piece 682 may be made of plastic, or a plastic piece is enclosed around the positioning piece 682 to prevent the issue of position restoring failure of the blocking section 681.

With the lock module 41 of the key box of the present invention, a user may still open the key box with a key as an alternative solution in the event that a user forgets the password and cannot open the key box through the keypad module 40. To achieve the alternative solution, the strip section 642B of the lock sliding piece 64 comprises the breach 643, which has a sufficient width to avoid any contact with the blocking section 681 of the solenoid switch 68. Since the opening of the key box with the lock module 41 is rather an alternative solution which may not be utilized most of the time, a concealing cover 42 is provided to cover the lock module 41 for security and esthetic considerations when the lock module 41 is not in use. When a user needs to open the lock module 41, the concealing cover 42 may be moved by sliding to reveal the keyhole of the lock module 41 to allow a user to insert the key.

Therefore, the key box of the present invention provides dual functions of an electronic lock and a mechanical lock to optimize utilization flexibilities. Further, when the mechanical lock is not in use, the keyhole of the mechanical lock is covered to further offer security and esthetic effects.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A box, comprising:

a body;

a cover, pivotally connected with the body to render an open state and a closed state;

a panel set, embedded on the cover, comprising a keypad module and a lock module, switching between the open state and the closed state being performed by manipulating either the keypad module or the lock module; and a switch module provided at an inner side of the cover, the switch module comprises:

a plate;

a first sliding piece, slidably provided on the plate;

a pair of rotating pieces, rotatably provided on the plate; and an solenoid switch, comprising a blocking section, wherein the blocking section is positioned against the first sliding piece under the closed state and is disengaged from the first sliding piece under the open state.

2. The box as claimed in claim 1, wherein the sliding piece comprises a push piece for coordinating with the keypad module for switching the key box between the open state and the closed state.

3. The box as claimed in claim 2, wherein the panel set is configured with an opening, further comprises:

a pair of substantially parallel guiding tracks, positioned at two sides of the opening; and a button, accommodated in the opening, being restrained to slide along a predetermined direction according to the pair of guiding tracks.

4. The box as claimed in claim 1, wherein the plate further comprises a positioning piece for positioning the blocking section.

5. The box as claimed in claim 4, wherein the positioning piece comprises non-magnetizing material.

6. The box as claimed in claim 1, further comprising a second sliding piece slidably provided on the first sliding piece.

7. The box as claimed in claim 6, wherein the second sliding piece comprises a push piece for coordinating with the lock module for switching the box between the open state and the closed state.

8. The box as claimed in claim 1, further comprising a concealing cover for movably covering the lock module.

9. The box as claimed in claim 1, further comprising a circuit board near the keypad module, the circuit board being electrically connected with the keypad module and the solenoid switch.

* * * * *